US008786392B2

(12) United States Patent
Burrows

(10) Patent No.: US 8,786,392 B2
(45) Date of Patent: Jul. 22, 2014

(54) CORONA IGNITER WITH IMPROVED ENERGY EFFICIENCY

(75) Inventor: John Antony Burrows, Northwich (GB)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/402,217

(22) Filed: Feb. 22, 2012

(65) Prior Publication Data

US 2012/0212313 A1 Aug. 23, 2012

Related U.S. Application Data

(60) Provisional application No. 61/445,328, filed on Feb. 22, 2011.

(51) Int. Cl.
*H01F 27/02* (2006.01)
*H01F 38/12* (2006.01)

(52) U.S. Cl.
USPC ..... 336/90; 336/96; 123/634

(58) Field of Classification Search
USPC ..... 336/65, 83, 90, 96, 174, 178, 212, 229; 123/143 R, 594, 606, 534, 634
See application file for complete search history.

(56) References Cited

U.S. PATENT DOCUMENTS

| | | | | |
|---|---|---|---|---|
| 1,801,608 | A | 4/1931 | Lee | |
| 2,660,622 | A * | 11/1953 | Field et al. | 360/125.01 |
| 2,920,237 | A * | 1/1960 | Berger | 315/138 |
| 5,128,646 | A | 7/1992 | Suzuki et al. | |
| 5,285,760 | A * | 2/1994 | Takaishi et al. | 123/634 |
| 5,313,927 | A * | 5/1994 | Takaishi | 123/634 |
| 5,477,203 | A * | 12/1995 | Sawazaki et al. | 336/92 |
| 5,767,759 | A | 6/1998 | Rouet | |
| 5,844,462 | A | 12/1998 | Rapoport et al. | |
| 6,107,790 | A * | 8/2000 | Sawazaki et al. | 323/371 |
| 6,337,616 | B1 | 1/2002 | Sato et al. | |
| 6,545,415 | B1 * | 4/2003 | Ward | 315/56 |

(Continued)

FOREIGN PATENT DOCUMENTS

| | | |
|---|---|---|
| DE | 19800924 C1 | 5/1999 |
| DE | 10048053 A1 | 6/2002 |

(Continued)

OTHER PUBLICATIONS

International Search Report PCT/US2012/026018 mailed on May 18, 2012.

*Primary Examiner* — Alexander Talpalatski
*Assistant Examiner* — Joselito Baisa
(74) *Attorney, Agent, or Firm* — Robert L. Stearns; Dickinson Wright, PLLC

(57) ABSTRACT

A corona igniter 20 includes a coil 24 with a plurality of copper windings 26 extending longitudinally along a coil center axis $a_c$. A magnetic core 30 is disposed along the coil center axis $a_c$ between the windings 26 and includes a plurality of discrete sections 32. The discrete sections 32 are spaced axially from one another by a core gap 34 filled with a non-magnetic gap filler 78. The magnetic core 30 has a core length $l_m$ and the coil 24 has a coil length $l_c$ less than the core length $l_m$. A coil former 62 having a former thickness $t_f$ spaces the coil 24 from the magnetic core 30. A length difference $l_d$ between the core length $l_m$ and the coil length $l_c$ is preferably equal to or greater than the former thickness $t_f$.

17 Claims, 11 Drawing Sheets

(56) References Cited

U.S. PATENT DOCUMENTS

| | | | | |
|---|---|---|---|---|
| 6,639,498 | B2 * | 10/2003 | Shimada et al. | 336/96 |
| 6,883,507 | B2 | 4/2005 | Freen | |
| 6,940,382 | B2 * | 9/2005 | Ishikawa et al. | 336/90 |
| 7,009,483 | B2 * | 3/2006 | Takeyama et al. | 336/96 |
| 7,098,765 | B2 | 8/2006 | Fujiyama et al. | |
| 7,239,224 | B2 | 7/2007 | Wada | |
| 7,741,761 | B2 | 6/2010 | Jaffrezic et al. | |
| 7,849,843 | B2 | 12/2010 | Kojima et al. | |
| 8,157,781 | B2 * | 4/2012 | Takino et al. | 604/385.27 |
| 2010/0083942 | A1 | 4/2010 | Lykowski et al. | |
| 2010/0175653 | A1 | 7/2010 | Lykowski et al. | |
| 2010/0175655 | A1 | 7/2010 | Lykowski et al. | |
| 2010/0187999 | A1 | 7/2010 | Agneray et al. | |
| 2010/0282197 | A1 | 11/2010 | Permuy et al. | |
| 2011/0146640 | A1 | 6/2011 | Achstaetter et al. | |

FOREIGN PATENT DOCUMENTS

| | | | |
|---|---|---|---|
| EP | 1586768 | A2 | 10/2005 |
| FR | 2 859 831 | A1 | 9/2012 |
| WO | 9965041 | A1 | 12/1999 |

* cited by examiner

CORONA IGNITER WITH IMPROVED ENERGY EFFICIENCY

CROSS REFERENCE TO RELATED APPLICATION

This application claims the benefit of application Ser. No. 61/445,328, filed Feb. 22, 2011, the contents of which is incorporated herein by reference in its entirety.

BACKGROUND OF THE INVENTION

1. Field of the Invention

This invention relates generally to igniters for igniting fuel-air mixtures in combustion chambers, and more specifically to the energy efficiency of corona igniters.

2. Related Art

An example of a corona discharge ignition system is disclosed in U.S. Pat. No. 6,883,507 to Freen. The corona discharge ignition system includes a corona igniter with an electrode charged to a high radio frequency voltage potential. Like igniters of other types of ignition systems, the corona igniter includes an ignition coil with a plurality of windings surrounding a magnetic core and transmitting energy from a power source to the electrode. An example of an ignition coil of a corona igniter is shown in FIG. 4. The corona igniter receives the energy at a first voltage and transmits the energy to the electrode at a second voltage, typically 15 to 50 times higher than the first voltage. The electrode then creates a strong radio frequency electric field causing a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture.

The ignition coil of the corona igniter is designed to create, in conjunction with the firing end assembly, a resonant L-C system capable of producing a high voltage sine wave when fed with a signal of suitable voltage and frequency. During operation of the corona igniter, an electric current flows through the coil, causing a magnetic field to form around the coil. Ideally, magnetic flux lines would follow the magnetic core through the entire length of the coil, exit the ends of the magnetic core, and then return around the outside of the coil. In this ideal situation, all the magnetic flux would be linked with all the windings, and the magnetic flux density would be equal at all radial cross sections of the magnetic core. Further, the magnetic core would ideally be sized according to the desired electrical behavior and the material properties and therefore would provide low electrical and energy losses.

In reality, however, the magnetic flux density is much greater in the center of the magnetic core, as shown in FIG. 5A, wherein the darker regions correspond to higher magnetic flux densities. The corresponding magnetic flux lines are shown in FIG. 7. The high magnetic flux density in the center occurs because a significant amount of magnetic flux passes partially through the magnetic core and then loops back radially through the windings prior to reaching the ends of the magnetic core. The increased magnetic flux density in the center of the magnetic core pushes the magnetic material toward saturation and ultimately results in high heat and high energy losses.

The magnetic flux that exits the magnetic core prior to reaching the ends of the magnetic core has a negative effect on the current flow through the windings. Where the magnetic flux passes through the windings, adjacent the opposite ends of the magnetic core, the current density within the windings is locally increased, as shown in FIG. 6A, such that the current density over the cross section of the windings is unequal. The increased current density results in increased resistance and thus higher energy lost as heat. The current flowing through the negatively affected windings is lower in the center of the wire, and the current is forced to flow through a relatively small cross-sectional area, adjacent the outer surface of the wire, relative to the total the cross-sectional area of the affected wire. This effectively reduces the functional and operational cross section of the wire and gives a far higher resistance, resulting in high energy losses.

SUMMARY OF THE INVENTION

One aspect of the invention provides an igniter for igniting a fuel-air mixture in a combustion chamber. The igniter includes a coil extending longitudinally along a coil center axis for receiving energy at a first voltage and transmitting the energy at a second voltage higher than the first voltage. The coil includes a plurality of windings each extending circumferentially around the coil center axis. A magnetic core is disposed along the coil center axis between the windings, and the magnetic core includes a plurality of discrete sections. Each of the discrete sections is spaced axially from an adjacent one of the discrete sections by a core gap.

According to another aspect of the invention, the igniter is a corona igniter for providing a radio frequency electric field to ionize a portion of the fuel-air mixture and provide a corona discharge in the combustion chamber. The corona igniter includes the coil and the magnetic core with the discrete sections.

Yet another aspect of the invention provides a method of forming the igniter. The method includes providing the coil including the plurality of windings each extending circumferentially around the coil center axis, disposing the discrete sections of the magnetic core along the coil center axis between the windings, and spacing each of the discrete sections from an adjacent one of the discrete sections by the core gap.

Forming the magnetic core with the discrete sections causes the magnetic flux and current density to disperse more evenly throughout the magnetic core and the windings. The igniter provides lower hysteresis losses, lower resistance in the coil, and less unwanted heating of the coil and the magnetic core which translates to an improved quality factor (Q). Accordingly, the igniter provides improved energy efficiency and performance, compared to igniters without the discrete sections.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
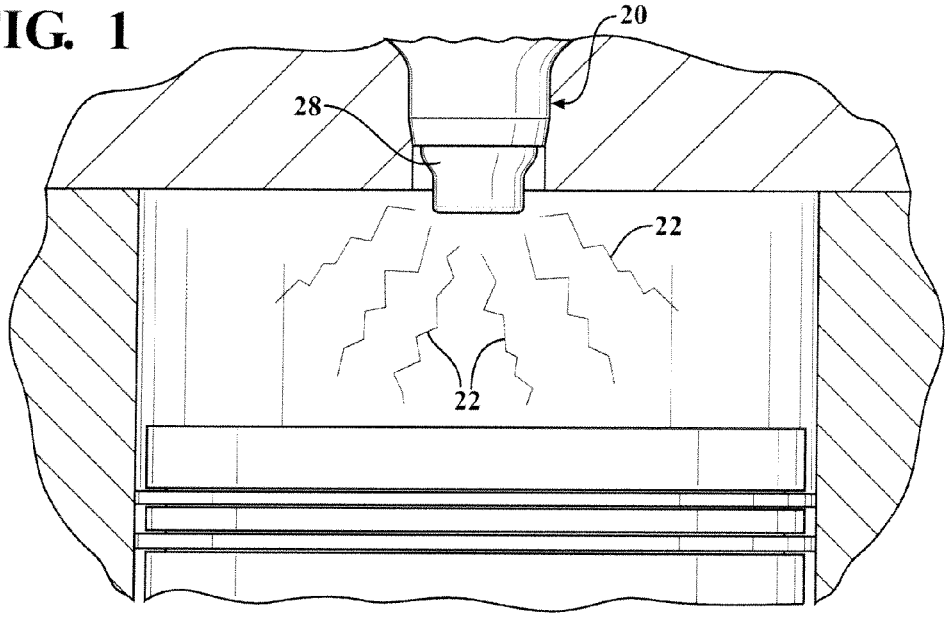
FIG. 1 is a cross-sectional view of a portion of a corona ignition system including an igniter according to one aspect of the invention.

One aspect of the invention provides an ignition system including an igniter 20 disposed in a combustion chamber containing a fuel-air mixture for providing a discharge to ionize and ignite the fuel-air mixture. The ignition system described herein is a corona ignition system, including a corona igniter 20, as shown in FIG. 1. However, the invention also applies to other types of igniters, for example those of a spark ignition system, a microwave ignition system, or another type of ignition system.

Figure 2A:
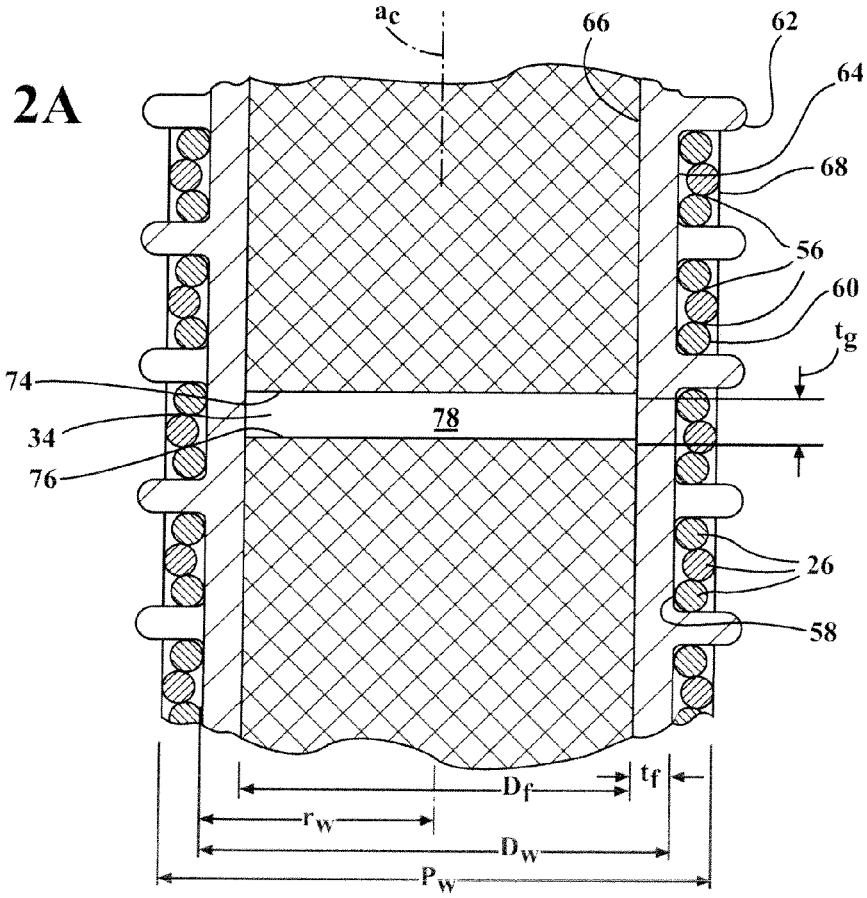
FIG. 2A is an enlarged view of a section of FIG. 2.
Figure 2:
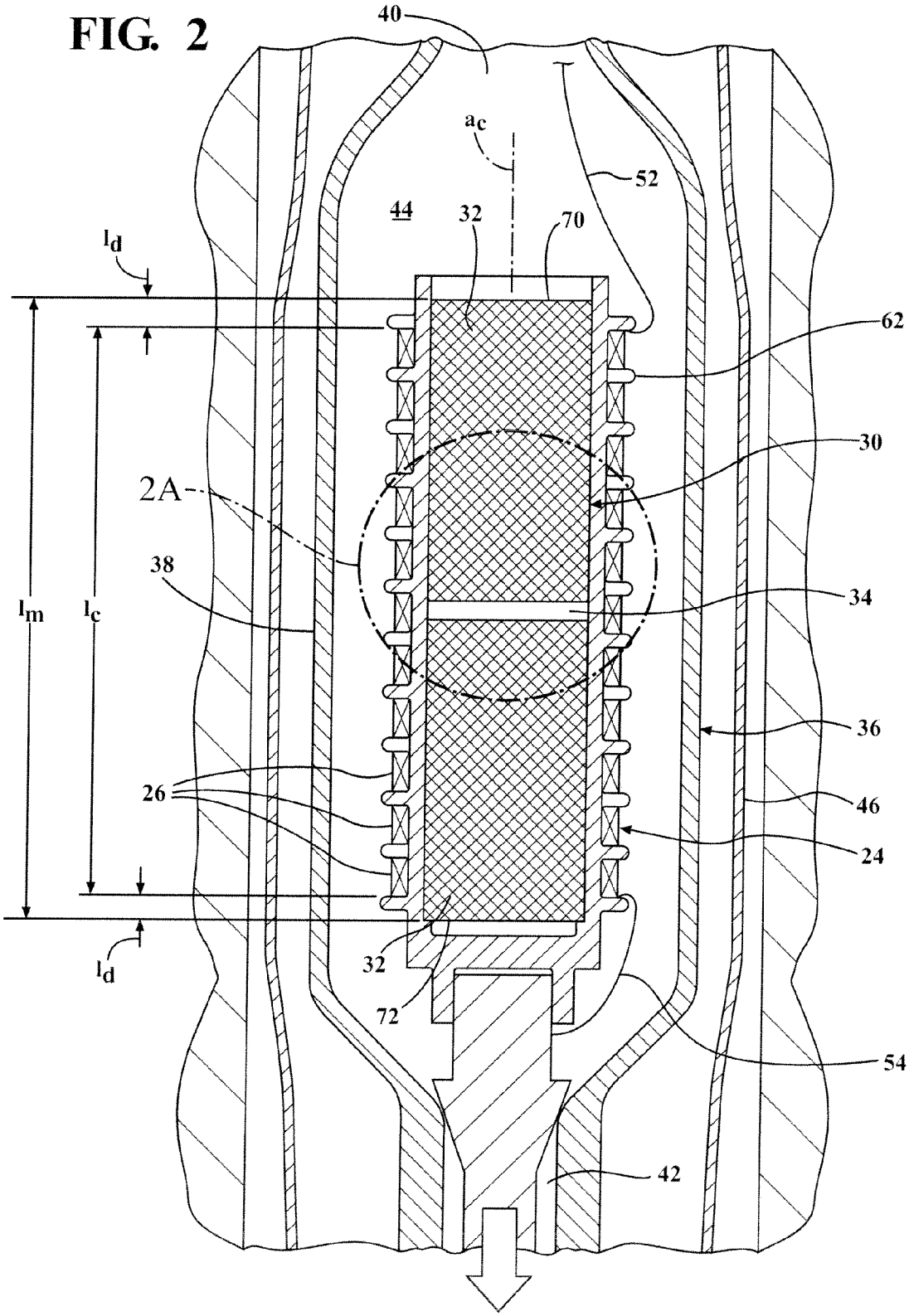
FIG. 2 is a cross-sectional view showing an ignition coil and magnetic core of an igniter according to one embodiment of the invention.

The corona igniter 20 is disposed in the combustion chamber and emits a radio frequency electric field to ionize a portion of the fuel-air mixture and provide a corona discharge 22 in the combustion chamber. The igniter 20 comprises an ignition coil 24 including a plurality of windings 26, as shown in FIG. 2, receiving energy from a power source (not shown) and transmitting the energy at a higher voltage to an electrode 28 (shown in FIG. 1). The igniter 20 also includes a magnetic core 30 disposed between the windings 26. The magnetic core 30 includes a plurality of discrete sections 32 spaced axially from one another by a core gap 34. Preferably, the core gap 34 is filed with a non-magnetic material and the magnetic core 30 has a core length $l_m$ extending past the windings 26. The design of the magnetic core 30 reduces energy loss caused by hysteresis and resistance of the coil 24, and therefore provides improved energy efficiency and performance, compared to corona igniters 20 without the discrete sections 32 of the magnetic core 30.

The corona igniter 20 includes a housing 36 having a plurality of walls 38 presenting a housing volume therebetween for containing the coil 24 and magnetic core 30. The walls 38 present a low voltage inlet 40 allowing energy to be transmitted from the power source (not shown) to the coil 24. The walls 38 also present a high voltage outlet 42 allowing energy to be transmitted from the coil 24 to the electrode 28. The low voltage inlet 40 and the high voltage outlet 42 are typically disposed along a coil center axis $a_c$, as shown in FIG. 2. The housing 36 may include side walls 38 extending parallel to the coil center axis $a_c$. An electrically insulating component 44 having a relative permittivity of less than 6 fills the housing 36, for example a pressurized gas, ambient air, insulating oil, or a low permittivity solid. The corona igniter 20 may also include a shield 46 formed of a conductive material, such as aluminum, surrounding the housing 36 to limit radiation of electro-magnetic interference.

The coil 24 is disposed in the center of the housing 36 and receives energy at a first voltage and transmits the energy at a second voltage being at least 15 times higher than the first voltage. The coil 24 extends from a coil low voltage end 48 adjacent the low voltage inlet 40 to a coil high voltage end 50 adjacent the high voltage outlet 42. A low voltage connector 52 extends through the low voltage inlet 40 into the housing 36 and transits the energy from the power source to the low voltage end of the coil 24. The electrode 28 (shown in FIG. 1) is electrically coupled to the coil 24 by a high voltage connector 54. The high voltage connector 54 extends through the high voltage outlet 42 and transmits the energy from the coil 24 to the electrode 28.

As shown in FIG. 2, the coil 24 has a coil length $l_c$ extending longitudinally along the coil center axis $a_c$ from the coil low voltage end 48 to the coil high voltage end 50. The coil 24 is typically formed of copper or a copper alloy and has an inductance of at least 500 micro henries.

Figure 2B:
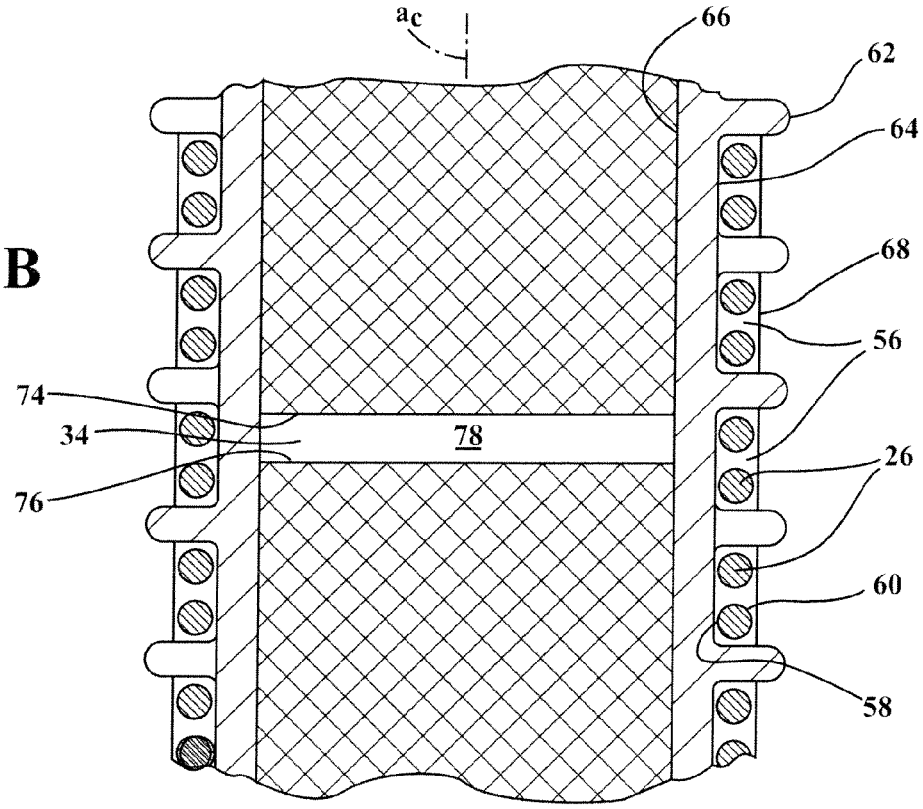
FIG. 2B is an alternate embodiment showing a single layer of windings.

The coil 24 includes a plurality of windings 26 each extending circumferentially around and longitudinally along the coil center axis $a_c$, as shown in FIG. 2. Each winding 26 is horizontally aligned with an adjacent one of the windings 26. The coil 24 presents a plurality of winding gaps 56, with each winding gap 56 spacing one of the windings 26 from the adjacent winding 26. In one embodiment, the coil 24 includes multiple layers of windings 26, as shown in FIG. 2A. In another embodiment, the coil 24 includes a single layer of windings 26, as shown in FIG. 2B.

The windings 26 present an interior winding surface 58 facing the coil center axis $a_c$ and an exterior winding surface 60 facing opposite the interior winding surface 58. The interior winding surface 58 is at a point along the winding 26 closest to the coil center axis $a_c$, and the exterior winding surface 60 is at a point along the winding 26 farthest from the coil center axis $a_c$, as shown in FIG. 2A. When the coil 24 includes multiple layers of windings 26, the interior winding surface 58 is on the winding 26 closest to the coil center axis $a_c$ and the exterior surface is on the winding 26 farthest from the coil center axis $a_c$.

The windings 26 present an interior winding diameter $D_w$ extending through and perpendicular to the coil center axis $a_c$ between opposite sides of the interior winding surface 58. In one example embodiment, the interior winding diameter $D_w$ is from 10 to 30 mm. An interior winding radius $r_w$ extends from the interior winding surface 58 along the interior winding diameter $D_w$ to the coil center axis $a_c$. In the example embodiment, the interior winding radius $r_w$ is from 5 to 15 mm. The windings 26 also present a winding perimeter $P_w$ extending through and perpendicular to the coil center axis $a_c$ between opposite sides of the exterior winding surface 60. In the example embodiment, the winding perimeter $P_w$ is from 10.5 to 40 mm. As shown in FIG. 2A, a winding thickness $t_w$ extends between the interior winding surface 58 and the exterior winding surface 60.

Figure 3A:
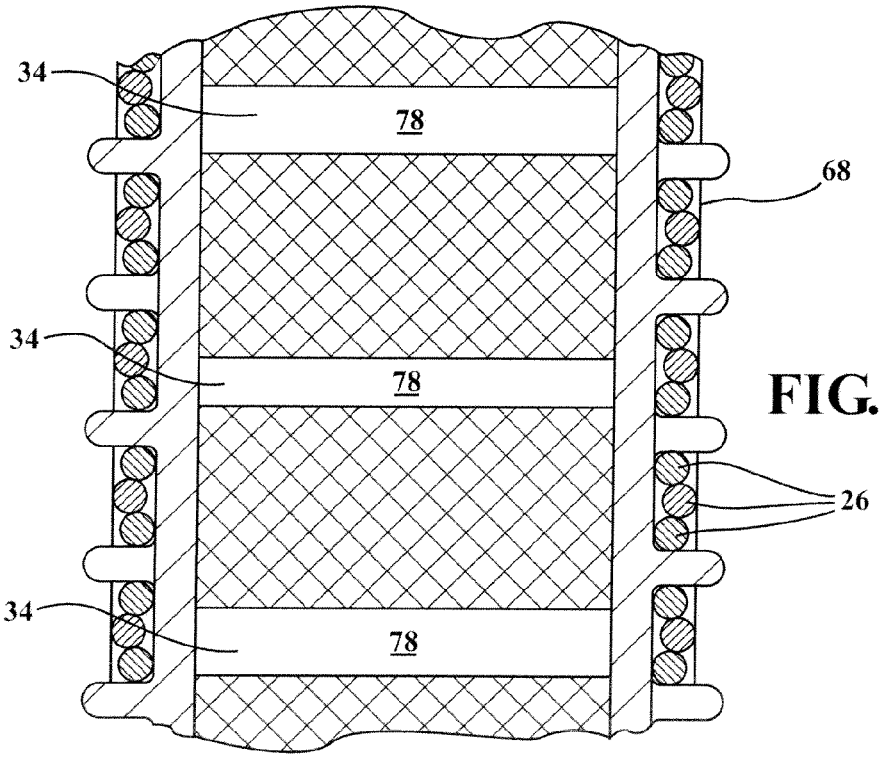
FIG. 3A is an enlarged view of a section of FIG. 3.
Figure 3:
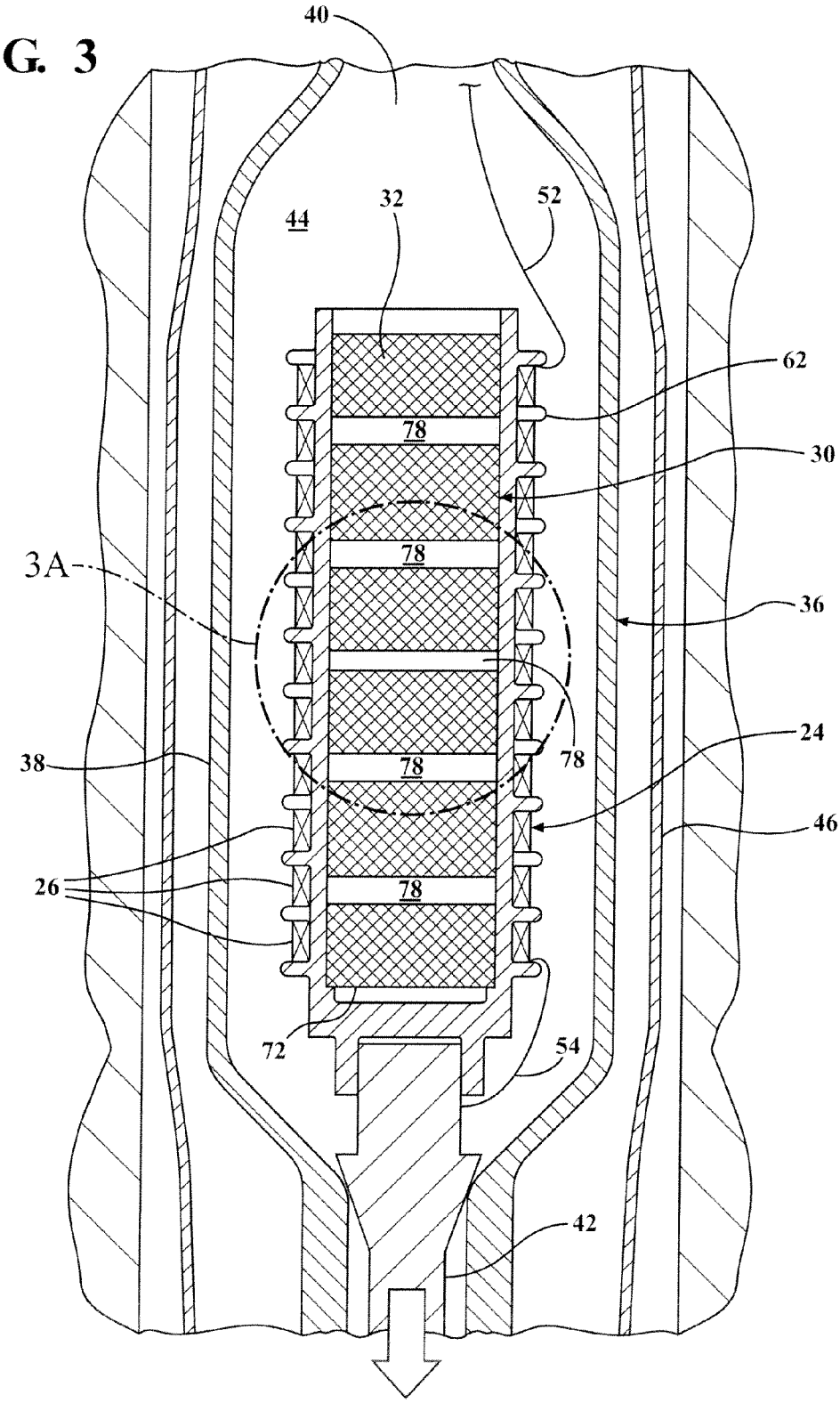
FIG. 3 is a cross-sectional view showing an ignition coil and magnetic core of an igniter according to another embodiment of the invention.

A coil former 62 made of electrically insulating non-magnetic material is typically used to space the windings 26 from the coil center axis $a_c$ and the magnetic core 30. The coil former 62 extends longitudinally along the coil center axis $a_c$, as shown in FIG. 2. The coil former 62 has a former exterior surface 64 engaging the interior winding surface 58 and a former interior surface 66 facing opposite the former exterior surface 64 toward the coil center axis $a_c$ and extending circumferentially around the coil center axis $a_c$. The former presents a former interior diameter $D_f$ extending through the coil center axis $a_c$ between opposite sides of the former interior surface 66. A former thickness $t_f$ is presented between the former interior surface 66 and the former exterior surface 64, and in the example embodiment, the former thickness $t_f$ is from 1 mm to 5 mm. The coil former 62 shown in FIGS. 2-3A is binned. However, the coil former 62 can alternatively comprise a plain tube, without bins. For example, the single layer of windings 26 is typically disposed along the surface of the plain tube.

A coil filler 68 formed of electrically insulating material is typically disposed in the winding gaps 56 around the windings 26. Examples of the insulating material include silicone resin and epoxy resin, which are disposed on the coil 24 and then cured prior to disposing the coil 24 in the housing 36. The coil filler 68 preferably spaces each of the windings 26 from the adjacent winding 26, as shown in FIGS. 2A and 2B. The coil filler 68 has a dielectric strength of at least 3 kV/mm, a thermal conductivity of at least 0.125 W/m·K, and a relative permittivity of at less than 6.

The magnetic core 30 is formed of a magnetic material and is disposed along the coil center axis $a_c$ between the windings 26. The magnetic core 30 is received in the coil former 62 and is engaged by the former interior surface 66. In the example embodiment, the magnetic core 30 has a diameter of 9.9 to 25 mm. The magnetic material of the magnetic core 30 has a relative permeability of at least 125, and is typically a ferrite or a powdered iron material.

As shown in FIG. 2, the magnetic core 30 has a core length $l_m$ extending axially along the coil center axis $a_c$ from a core low voltage end 70 adjacent the coil low voltage end 48 to a core high voltage end 72 adjacent the coil high voltage end 50. It also extends around the coil center axis $a_c$, continuously along the former interior surface 66, and continuously across the former interior diameter $D_f$. The core length $l_m$ and the coil length $l_c$ present a length difference $l_d$ therebetween. The core length $l_m$ is preferably greater than the coil length $l_c$. In one embodiment, the length difference $l_d$ is equal to or greater than the former thickness $t_f$, and more preferably the length difference $l_d$ is equal to or greater than the interior winding radius $r_w$. In the example embodiment, the core length $l_m$ is from 20 to 75 mm. The extended core length $l_m$ can be provided by either increasing the size of the magnetic core 30, or by reducing the number of windings 26.

The discrete sections 32 of the magnetic core 30 together provide the core length $l_m$. The discrete sections 32 each typically include a planar bottom surface 74 facing toward the high voltage outlet 42 and a planar top surface 76 facing opposite the bottom surface 74 toward the low voltage inlet 40. The bottom surface 74 of one of the discrete sections 32 faces and is parallel to the top surface 76 of the adjacent discrete section 32. Each discrete section 32 is completely spaced axially from the adjacent discrete section 32 along the coil center axis $a_c$ by one of the core gaps 34. The core gaps 34 each extend continuously across the former interior diameter $D_f$ perpendicular to the coil center axis $a_c$ and have a gap thickness $t_g$ extending axially along the coil center axis $a_c$. In the embodiment of FIGS. 2-2B, the corona igniter 20 includes a single core gap 34 spacing a pair of discrete sections 32. However, the corona igniter 20 can alternatively include a plurality of core gaps 34, as shown in FIGS. 3 and 3A, wherein each of the core gaps 34 are disposed between the coil low voltage end 48 and the coil high voltage end 50. The gap thickness $t_g$ of each core gap 34 is preferably between 1 and 10% of the core length $l_m$, and the gap thicknesses $t_g$ of all of the core gaps 34 together present a total gap thickness which is not greater than 25% of the core length $l_m$.

The corona igniter 20 also includes a gap filler 78 formed of a non-magnetic material disposed in the core gap 34. The non-magnetic material has a relative permeability of not greater than 15, for example nylon, polytetrafluoroethylene (PTFE), or polyethylene terephthalate (PET). In one embodiment, the gap filler 78 is a rubber spacer.

Another aspect of the invention provides a method of forming the corona igniter 20 described above. The method includes providing the coil 24 extending longitudinally along the coil center axis $a_c$, disposing the discrete sections 32 of the magnetic core 30 along the coil center axis $a_c$ between the windings 26, and spacing each of the discrete sections 32 of the magnetic core 30 axially from the adjacent discrete section 32 by one of the core gaps 34. The method also typically includes disposing the gap filler 78 formed of the non-magnetic material in the core gaps 34, and electrically coupling the electrode 28 to the coil 24.

Figure 4:
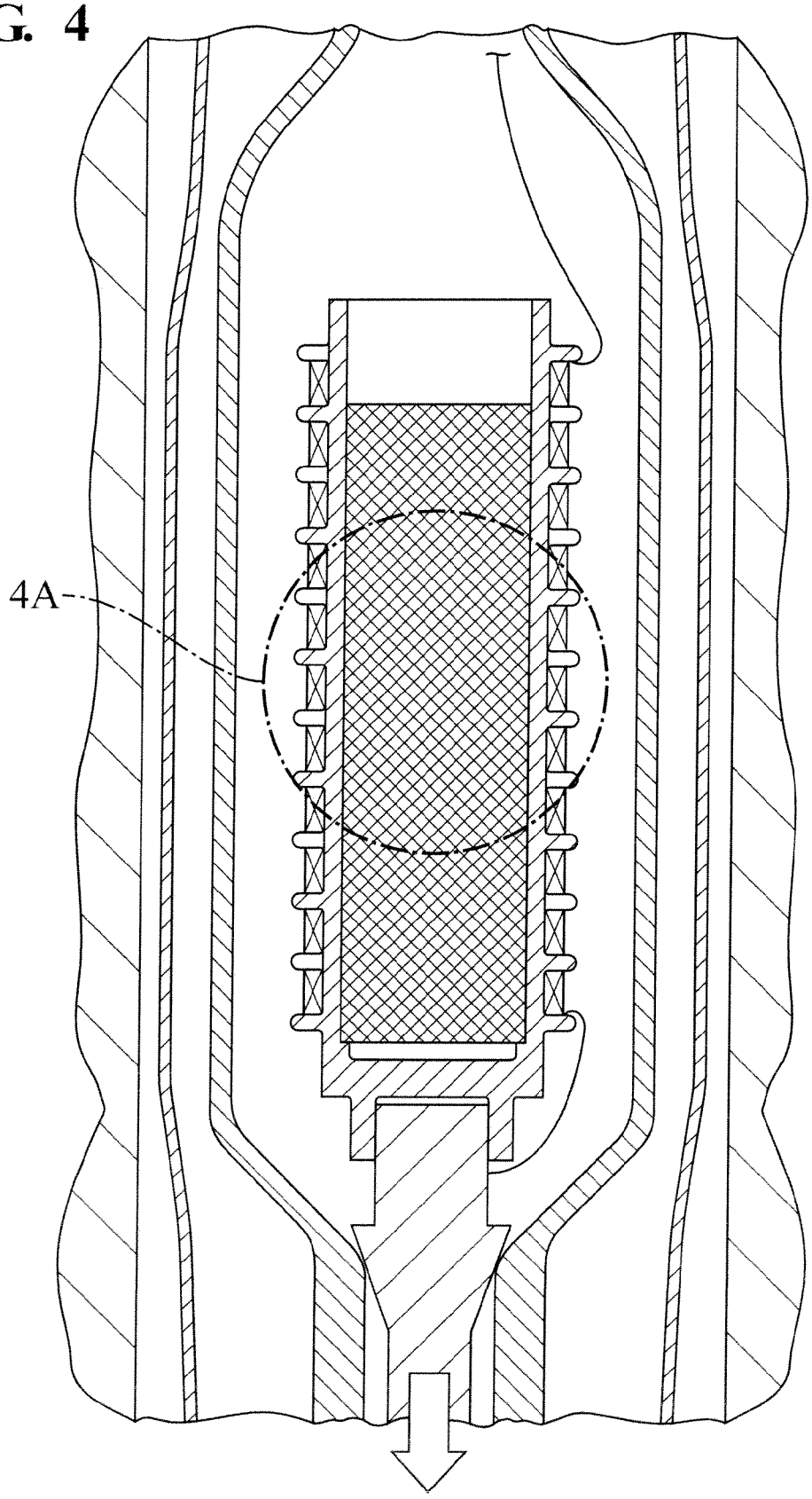
FIG. 4 is a cross-sectional view showing an ignition coil and magnetic core of a comparative igniter.
Figure 4A:
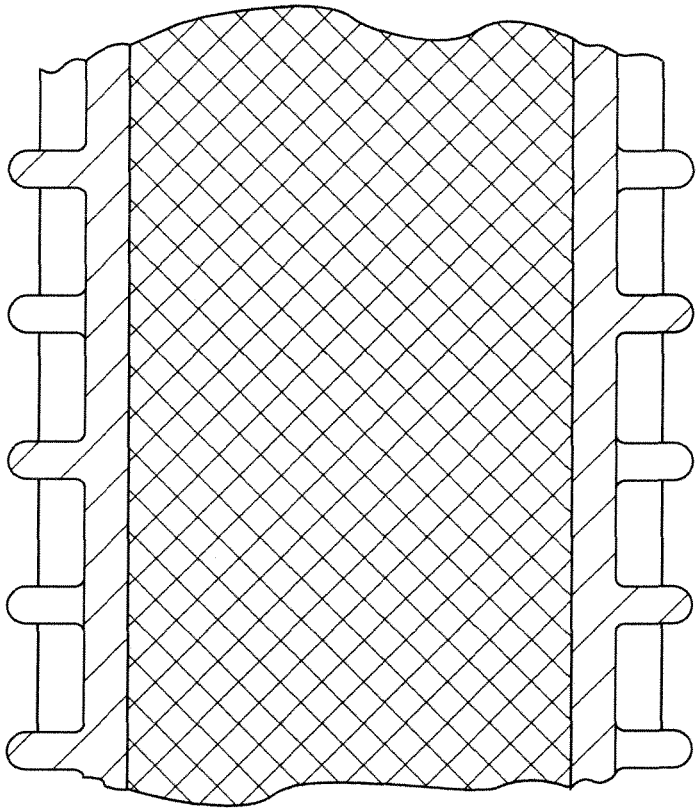
FIG. 4A is an enlarged view of a section of FIG. 4.
Figure 5A:
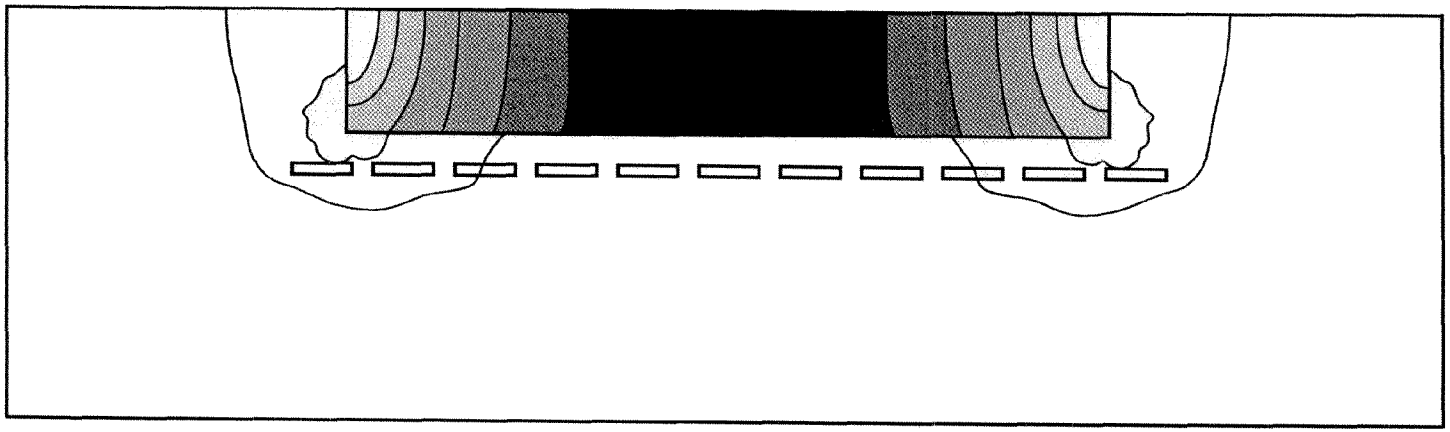
FIG. 5A illustrates the magnetic flux along the coil and magnetic core of FIG. 4.
Figure 5B:
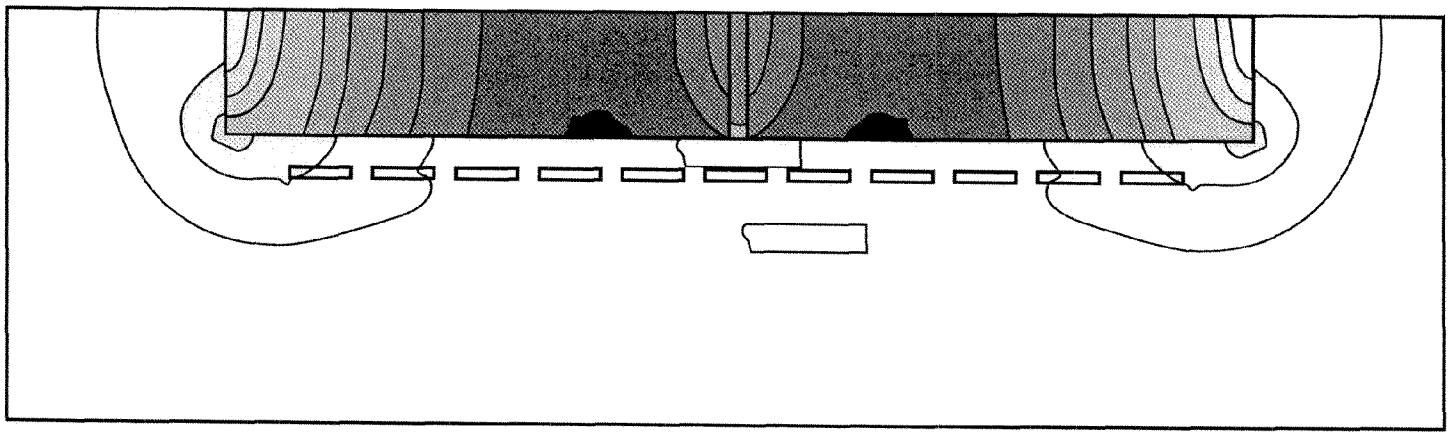
FIG. 5B illustrates the current density and magnetic flux along the coil and magnetic core of FIG. 2.
Figure 6A:
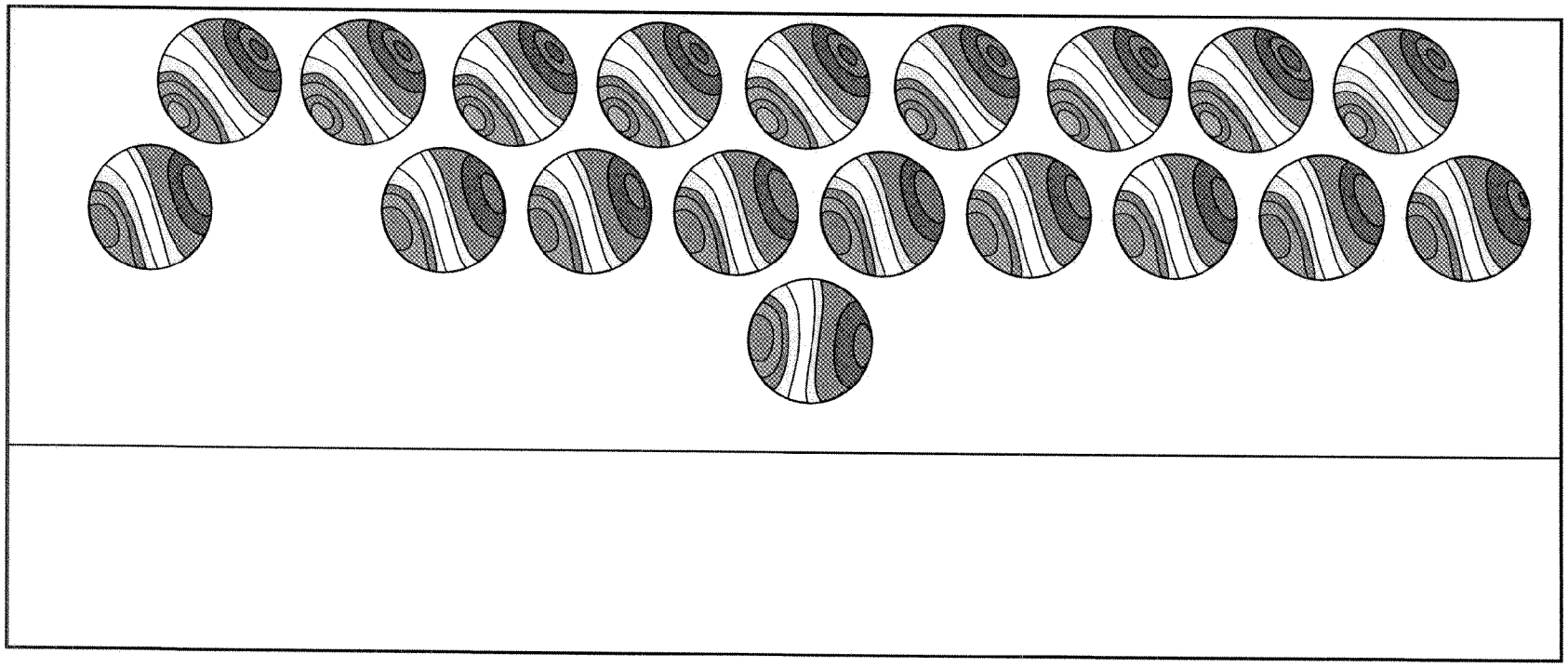
FIG. 6A illustrates the current density in the windings of FIG. 4.
Figure 6B:
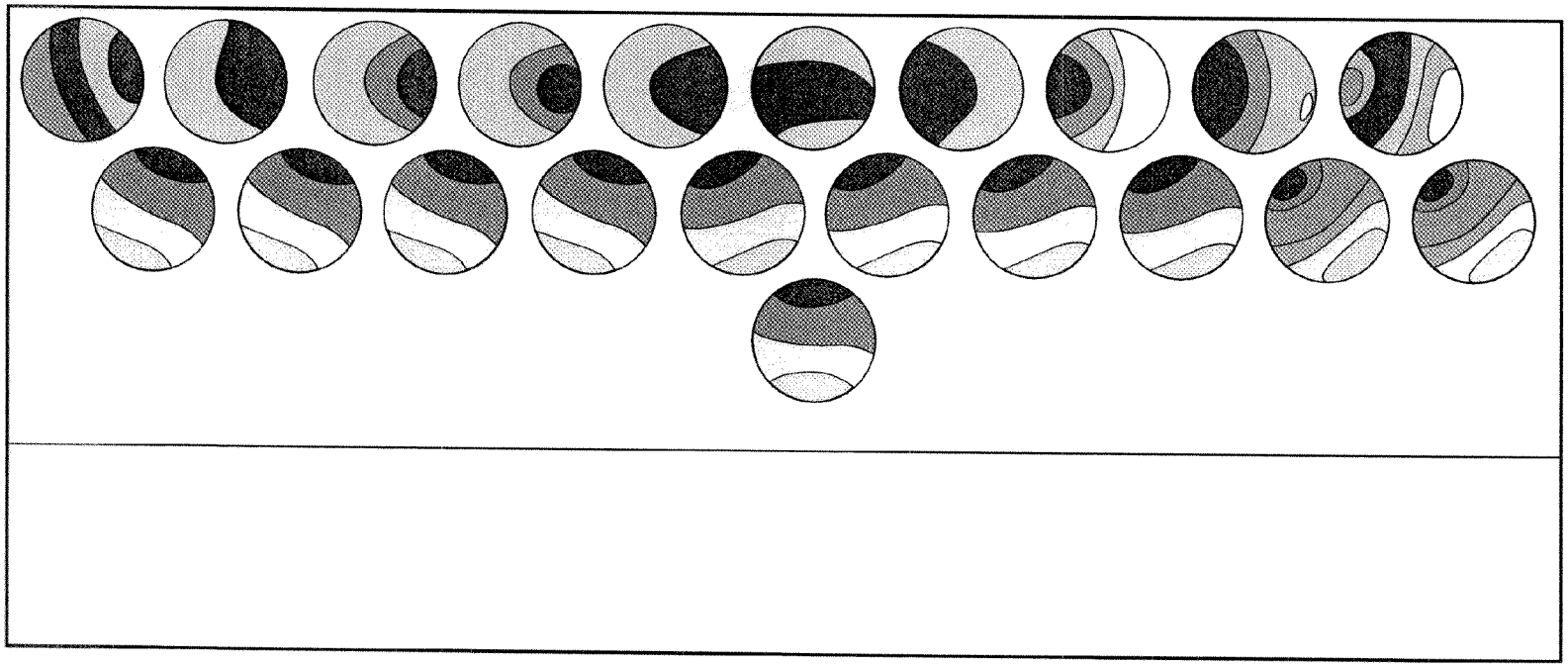
FIG. 6B illustrates the currently density in the windings of FIG. 2.
Figure 7:
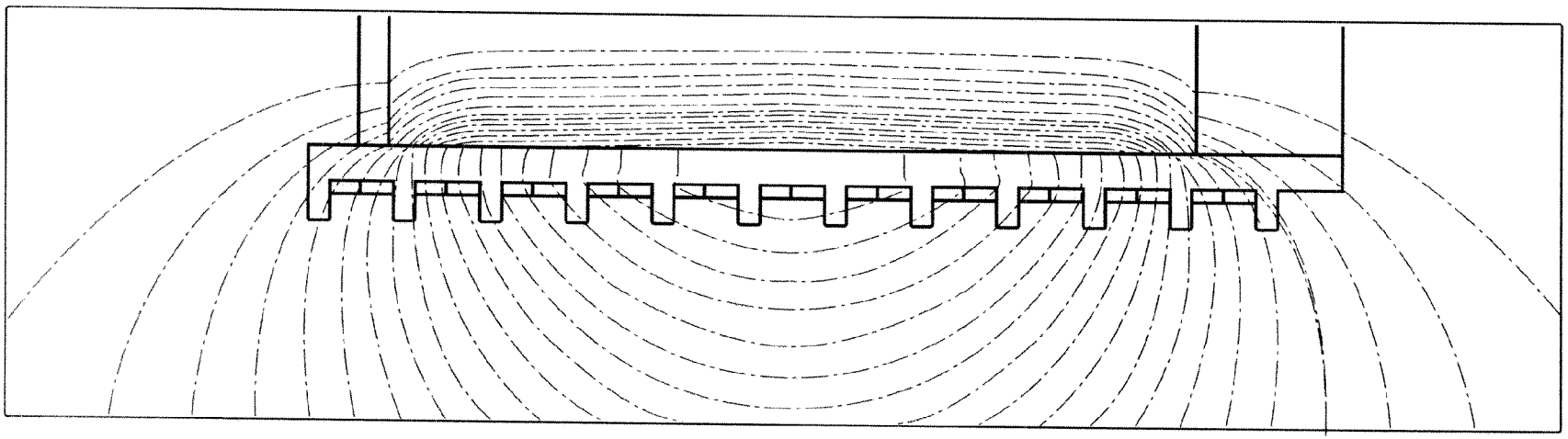
FIG. 7 illustrates the magnetic flux lines along the coil and magnetic core of FIG. 4.
Figure 8:
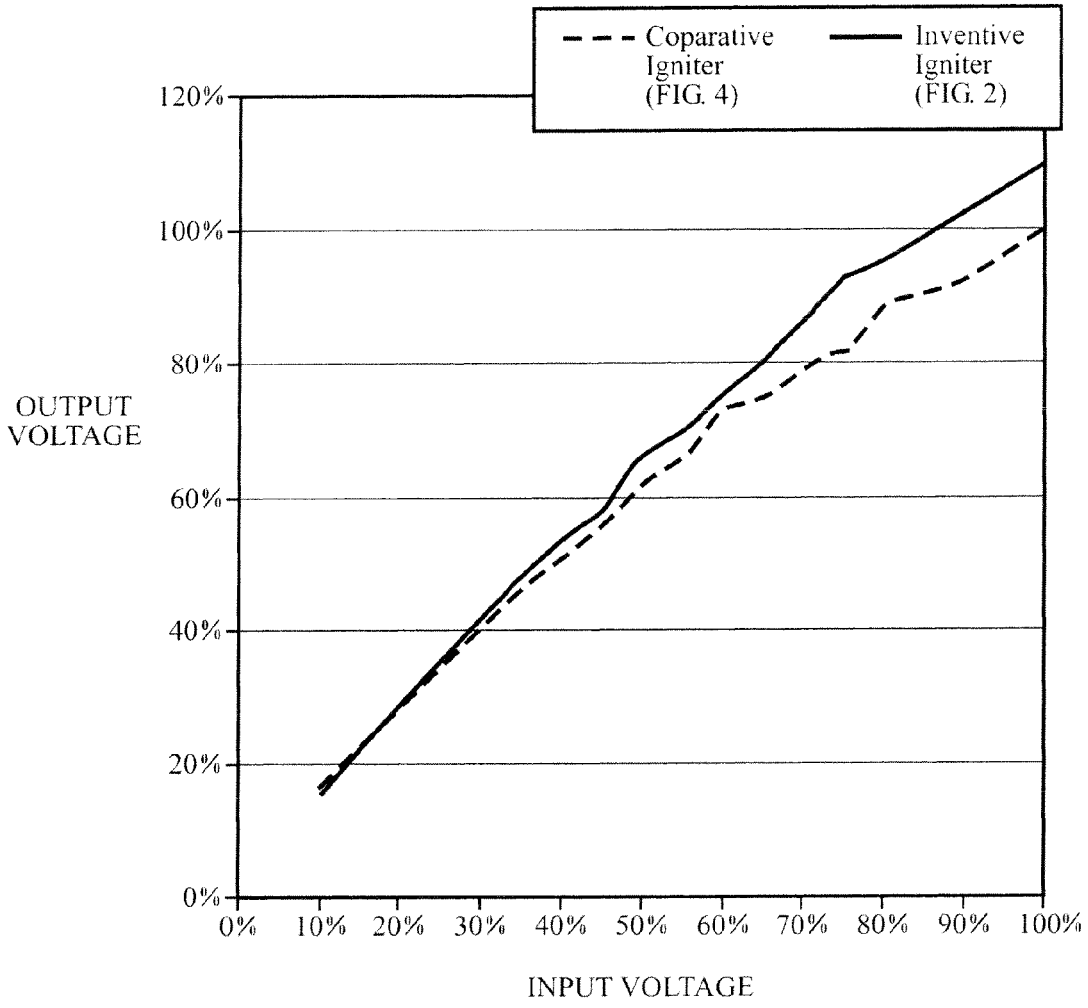
FIG. 8 illustrates the improved energy efficiency of the igniter of FIG. 2 over the comparative igniter of FIG. 4.

The corona igniter 20 including the magnetic core 30 with discrete sections 32 provides an improved quality factor (Q), which is equal to the ratio of impedance (due to pure inductance of the system) to parasitic resistance of the ignition system. The improved Q means the igniter 20 has lower hysteresis losses, lower resistance in the coil 24, and less unwanted heating of the coil 24 and the magnetic core 30. Accordingly, the igniter 20 provides improved energy efficiency and performance, compared to igniters 20 without the discrete sections 32 of the magnetic core 30. FIGS. 5A and 5B illustrate the magnetic flux in the magnetic core 30 of the corona igniter 20 of FIG. 2 (with discrete sections 32) is significantly lower than the comparative corona igniter 20 of FIG. 4 (without discrete sections 32). The darker regions of FIGS. 5A and 5B correspond to higher magnetic flux densities. FIGS. 6A and 6B illustrate the electric current in the windings 26 of FIG. 2A is more evenly distributed than the electric current in the same windings 26 used in the comparative corona igniter 20 of FIG. 4 (without discrete sections 32). The darker regions of FIGS. 6A and 6B correspond to higher current densities. FIG. 8 is a plot of input voltage versus output voltage of the corona igniter 20 of FIG. 2 and the corona igniter 20 of FIG. 4. FIG. 8 illustrates the improved energy efficiency of the corona igniter 20 of FIG. 1 over the comparative corona igniter 20 of FIG. 4.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

ELEMENT LIST

| Element Symbol | Element Name |
|---|---|
| 20 | igniter |
| 22 | corona discharge |
| 24 | coil |
| 26 | windings |
| 28 | electrode |
| 30 | magnetic core |
| 32 | sections |
| 34 | core gap |
| 36 | housing |
| 38 | walls |
| 40 | low voltage inlet |
| 42 | high voltage outlet |
| 44 | electrically insulating component |
| 46 | shield |
| 48 | coil low voltage end |
| 50 | coil high voltage end |
| 52 | low voltage connector |
| 54 | high voltage connector |
| 56 | winding gap |
| 58 | interior winding surface |
| 60 | exterior winding surface |

-continued

| ELEMENT LIST | |
|---|---|
| Element Symbol | Element Name |
| 62 | coil former |
| 64 | former exterior surface |
| 66 | former interior surface |
| 68 | coil filler |
| 70 | core low voltage end |
| 72 | core high voltage end |
| 74 | bottom surface |
| 76 | top surface |
| 78 | gap filler |
| $a_c$ | coil center axis |
| $D_f$ | former interior diameter |
| $D_w$ | interior winding diameter |
| $l_c$ | coil length |
| $l_d$ | length difference |
| $l_m$ | core length |
| $P_w$ | winding perimeter |
| $r_w$ | interior winding radius |
| $t_f$ | former thickness |
| $t_g$ | gap thickness |
| $t_w$ | winding thickness |

What is claimed is:

1. An igniter for igniting a fuel-air mixture in a combustion chamber, comprising:

a coil extending longitudinally along a coil center axis for receiving energy at a first voltage and for transmitting the energy at a second voltage higher than the first voltage, said coil including a plurality of windings each extending circumferentially around said coil center axis, each of said windings presenting a winding gap spacing said winding from an adjacent one of said adjacent windings, a magnetic core disposed along said coil center axis between said windings, said magnetic core including a plurality of discrete sections, each of said discrete sections being spaced axially from an adjacent one of said discrete sections by a core gap, wherein said coil extends longitudinally from a coil low voltage end for receiving the energy at the first voltage to a high voltage end, said coil presents a coil length between said coil low voltage end and said coil high voltage end, said magnetic core extends from a core low voltage end adjacent said coil low voltage end to a core high voltage end adjacent said coil high voltage end, said discrete sections of said magnetic core together present a core length extending from said core low voltage end to said core high voltage end, and said core length is greater than said coil length, a coil former made of an electrically insulating non-magnetic material and presenting a former thickness spacing said windings from said magnetic core, wherein said coil length and said core length present a length difference therebetween and said length difference is equal to or greater than said former thickness, a coil filler formed of an electrically insulating material different from said coil former disposed in said winding gaps and spacing each of said windings from the adjacent one of said windings, and said coil filler having a dielectric strength of at least 3 kV/mm, a thermal conductivity of at least 0.125 W/m·K, and a relative permittivity of less than 6.

2. The igniter of claim 1, wherein each of said discrete sections is completely spaced axially from said adjacent one of said discrete sections by said core gap, and including a gap filler formed of a non-magnetic material disposed in said core gap.

3. The igniter of claim 2 wherein said gap filler has a relative permeability of not greater than 15.

4. The igniter of claim 1 wherein each of said discrete sections includes a bottom surface and a top surface each being planar, and said bottom surface of one of said discrete sections faces and is parallel to the top surface of an adjacent one of said discrete sections.

5. The igniter of claim 1 wherein each of said core gaps presents a gap thickness between 1% and 10% of said core length.

6. The igniter of claim 5 wherein said gap thicknesses of each of said core gaps together present a total gap thickness being not greater than 25% of said core length.

7. The igniter of claim 1 wherein said coil filler spaces each of said windings longitudinally from said adjacent one of said windings.

8. The igniter of claim 1 including a housing having a plurality of walls presenting a housing volume therebetween for containing said coil and said magnetic core, and an electrically insulating component having a relative permittivity of less than 6 filling said housing.

9. The igniter of claim 1 wherein said coil former extends longitudinally along said coil center axis and spaces said windings from said coil center axis, said coil former has a former exterior surface extending along said interior winding surface and a former interior surface engaging said magnetic core.

10. The igniter of claim 1 wherein said coil has an inductance of at least 500 micro henries and said magnetic core has a relative permeability of at least 125.

11. The igniter of claim 10 wherein said coil is formed of copper and said magnetic core is formed of a ferrite or powdered iron material.

12. The igniter of claim 1 including an electrode electrically coupled to said coil for receiving the energy from said coil.

13. An igniter for igniting a fuel-air mixture in a combustion chamber, comprising:

a coil extending longitudinally along a coil center axis for receiving energy at a first voltage and for transmitting the energy at a second voltage higher than the first voltage, said coil including a plurality of windings each extending circumferentially around said coil center axis, each of said windings presenting a winding gap spacing said winding from an adjacent one of said adjacent windings, a magnetic core disposed along said coil center axis between said windings, said magnetic core including a plurality of discrete sections, each of said discrete sections being spaced axially from an adjacent one of said discrete sections by a core gap, wherein said coil extends longitudinally from a coil low voltage end for receiving the energy at the first voltage to a high voltage end, said coil presents a coil length between said coil low voltage end and said coil high voltage end, said magnetic core extends from a core low voltage end adjacent said coil low voltage end to a core high voltage end adjacent said coil high voltage end, said discrete sections of said magnetic core together present a core length extending from said core low voltage end to said core high voltage end, and said core length is greater than said coil length, wherein said coil length and said core length present a length difference therebetween, said windings include an interior winding surface facing said coil center axis and present an interior winding radius extending from said interior winding surface to said coil center axis, and said length difference is equal to or greater than said interior winding radius, a coil former made of an electrically insulating material and spacing said windings from said magnetic core, a coil filler formed of an electrically insulating material different from said coil former disposed in said winding gaps and spacing each of said windings from the adjacent one of said windings, and said coil filler having a dielectric strength of at least 3 kV/mm, a thermal conductivity of at least 0.125 W/m·K, and a relative permittivity of less than 6.

14. A corona igniter for providing a radio frequency electric field to ionize a portion of a fuel-air mixture and provide a corona discharge in a combustion chamber, comprising:

a housing including a plurality of walls and presenting a housing volume therebetween, said walls presenting a low voltage inlet and a high voltage outlet each disposed along a coil center axis for allowing energy be transmitted through said housing volume, a shield of a conductive material surrounding said housing, a coil disposed in said housing for receiving energy at a first voltage and for transmitting the energy at a second voltage being at least 15 times higher than the first voltage, said coil having a coil length extending longitudinally along said coil center axis from a coil low voltage end adjacent said low voltage inlet for receiving the energy at the first voltage to a coil high voltage end adjacent said high voltage outlet for transmitting the energy at the second voltage, said coil having an inductance of at least 500 micro henries, said coil including a plurality of windings each extending circumferentially around and longitudinally along said coil center axis, each of said windings being horizontally aligned with an adjacent one of said windings and presenting a winding gap spacing said winding from said adjacent winding, said windings presenting an interior winding surface facing said coil center axis and an exterior winding surface facing opposite said interior winding surface, said windings presenting an interior winding diameter extending through and perpendicular to said coil center axis between opposite sides of said interior winding surface, said windings presenting an interior winding radius extending from said interior winding surface along said interior winding diameter to said coil center axis, said windings presenting a winding perimeter extending through and perpendicular to said coil center axis between opposite sides of said exterior winding surface, each of said windings presenting a winding thickness extending form said interior winding surface to said exterior winding surface, a low voltage connector for transmitting the energy form said power source to said low voltage end of said coil, an electrode electrically coupled to said coil for receiving the energy from said coil, a high voltage connector electrically coupling said coil and said electrode and for transmitting the energy form said coil to said electrode, a coil former made of electrically insulating non-magnetic material and extending longitudinally along said coil center axis and spacing said windings from said coil center axis, said coil former having a former exterior surface engaging said interior winding surface and a former interior surface facing opposite said former exterior surface toward said coil center axis and extending circumferentially around said coil center axis, said former interior surface presenting a former interior diameter extending through said coil center axis, said coil former presenting a former thickness between said former interior surface and said former exterior surface, a coil filler formed of electrically insulating material different from said coil former disposed in said winding gaps and spacing each of said windings from the adjacent one of said windings, said coil filler having a dielectric strength of at least 3 kV/mm, a thermal conductivity of at least 0.125 W/m·K, and a relative permittivity of less than 6, a magnetic core formed of a magnetic material disposed along said coil center axis between said windings, said magnetic core being received in said coil former and engaged by said former interior surface, said magnetic material having a relative permeability of at least 125, said magnetic core having a core length extending axially along said coil center axis from a core low voltage end adjacent said coil low voltage end to a core high voltage end adjacent said coil high voltage end, said magnetic core extending around said coil center axis continuously along said former interior surface and continuously across said former interior diameter, said magnetic core including a plurality of discrete sections together providing said core length, each of said discrete sections including a bottom surface facing toward said high voltage outlet and a top surface facing opposite said bottom surface toward said low voltage inlet, said bottom surface of one of said discrete sections facing and parallel to the top surface of the adjacent one of said discrete sections, said top surface and said bottom surface of said discrete sections being planar, said discrete sections being completely spaced axially from one another along said coil center axis, each of said discrete sections being spaced axially from an adjacent one of said discrete sections by a core gap, said core length being greater than said coil length, said core length and said coil length including a length difference therebetween, said length difference being equal to or greater than said former thickness, said length difference being equal to or greater than said interior winding radius, each of said core gaps extending continuously across said former interior diameter, each of said core gaps having a gap thickness extending axially along said coil center axis, said gap thickness of each of said core gaps being between 1 and 10% of said core length, said gap thicknesses of all of said core gaps together presenting a total gap thickness being not greater than 25% of said core length, and a gap filler formed of a non-magnetic material having a relative permeability of not greater than 15 disposed in said core gap.

15. A method of forming a igniter for providing a radio frequency electric field to ionize a portion of a fuel-air mixture and provide a corona discharge in a combustion chamber, comprising the steps of:

providing a coil extending longitudinally along a coil center axis from a coil low voltage end to a coil high voltage end and including a plurality of windings each extending circumferentially around the coil center axis, wherein each of the windings presents a winding gap spacing the winding from an adjacent one of the windings, and wherein the coil presents a coil length between the coil low voltage end and the coil high voltage end, disposing a plurality of discrete sections of a magnetic core formed of a magnetic material along the coil center axis between the windings, wherein the magnetic core extends from a core low voltage end adjacent the coil low voltage end to a core high voltage end adjacent the coil high voltage end, spacing each of the discrete sections of the magnetic core axially from an adjacent one of the discrete sections by a core gap, wherein the discrete sections of the magnetic core together present a core length extending from the core low voltage end to the core high voltage end, the core length is greater than the coil length, and the coil length and the core length present a length difference therebetween, spacing the windings from the magnetic core by a coil former made of an electrically insulating non-magnetic material, wherein the coil former presents a former thickness spacing the windings from the magnetic core, and the length difference between the coil length and the core length is greater than the former thickness, and disposing a coil filler formed of electrically insulating material different from the coil former in the winding gaps and spacing each of said windings from the adjacent one of said windings with the coil filler, the coil filler having a dielectric strength of at least 3 kV/mm, a thermal conductivity of at least 0.125 W/m·K and a relative permittivity of less than 6.

16. The method of claim 15 including the step of disposing a gap filler formed of a non-magnetic material in the core gap.

17. The igniter of claim 13 including a coil former made of an electrically insulating non-magnetic material and presenting a former thickness spacing said windings from said magnetic core.

* * * * *